US006102233A

United States Patent [19]

Waugh

[11] Patent Number: 6,102,233

[45] Date of Patent: Aug. 15, 2000

[54] CONTAINER

[75] Inventor: James Waugh, London, United Kingdom

[73] Assignee: Alligator Sales Limited, London, United Kingdom

[21] Appl. No.: 09/081,368

[22] Filed: May 19, 1998

[51] Int. Cl.[7] ..... B65D 21/02

[52] U.S. Cl. ..... 220/23.86; 220/23.4; 220/256; 220/737; 220/740; 215/386; 206/216; 206/223; 206/457

[58] Field of Search ..... 215/386, 400, 215/DIG. 7; 220/23.4, 23.6, 23.83, 23.86, 256, 724, 728, 737, 740; 206/216, 223, 457

[56] References Cited

U.S. PATENT DOCUMENTS

| | | | |
|---|---|---|---|
| 2,318,434 | 5/1943 | Strauch | 215/386 X |
| 2,874,835 | 2/1959 | Poupitch | 220/23.4 X |
| 3,027,037 | 3/1962 | Bronson et al. | 215/386 |
| 4,339,033 | 7/1982 | Cillario | 220/23.4 X |
| 5,005,721 | 4/1991 | Jordan | 220/23.4 |
| 5,318,787 | 6/1994 | Brauner et al. | 220/23.86 X |
| 5,361,918 | 11/1994 | Mason | 215/6 |
| 5,372,827 | 12/1994 | Brauner et al. | 220/23.6 X |

FOREIGN PATENT DOCUMENTS

| | | | |
|---|---|---|---|
| 2 615 490 | 11/1988 | France . | |
| 2 690 138 | 10/1993 | France . | |
| 2 704 209 | 10/1994 | France . | |
| 1191291 | 5/1970 | United Kingdom | 215/DIG. 7 |
| 1 269 036 | 3/1972 | United Kingdom . | |
| 2 264 921 | 9/1993 | United Kingdom . | |
| 2 289 455 | 11/1995 | United Kingdom . | |
| 2 289 456 | 11/1995 | United Kingdom . | |

*Primary Examiner*—Stephen K. Cronin
*Attorney, Agent, or Firm*—Flynn, Thiel, Boutell & Tanis, P.C.

[57] ABSTRACT

A container (10) suitable for mounting on the neck of a bottle or other vessel having an annular abutment surface formed thereon and for containing a gift item consists of first and second wall sections (12,14) which are fixed together to form a generally closed space containing the gift item. One of the wall sections (14) has formed in it an opening (17) having around its periphery a plurality of elongate resilient fingers (18) projecting into the interior of the container. The fingers (18) together define a substantially frusto-conical structure such that when the neck of the bottle or other vessel is inserted into the container (10) through the opening (17) the fingers (18) are forced apart to allow passage of the neck until they have moved over the abutment surface formed on it. The ends of the plurality of fingers (18) engaged with the abutment surface to oppose movement of the neck of the bottle or other vessel out of the container. The container thus provides a secure means for securing a gift item to the neck of the bottle or other vessel as part of a promotional exercise.

19 Claims, 5 Drawing Sheets

CONTAINER

The present invention relates to a container, in particular, to a container for mounting on the neck of a bottle or other vessel having an annular abutment surface formed thereon.

As a promotional measure, it has become increasingly common to offer gifts as an incentive to purchasers of products of various kinds, including those supplied in bottles, for example, beverages and other liquid products. Where the main purchase is supplied in a bottle, difficulty arises in finding a suitable means of mounting the container or package containing the gift on the bottle. If the gift is secured to the body of the bottle, the overall circumference of the item is increased, making it more difficult to fit an appropriate number of bottles on a shelf for display to purchasers. Whatever part of the bottle the gift is secured to, there is difficulty in securing it so that it simply cannot be removed and taken away without having been paid for.

In accordance with the invention, there is provided a container characterised in that it comprises a wall which defines a generally closed space; there being formed in the wall an opening for receiving the neck of said bottle or other vessel; the container further comprising a resilient retaining structure having an aperture which is aligned with the opening in the container wall and is of dimensions selected to be slightly smaller than those of the annular abutment surface on the neck of the bottle, the said structure being such that when the neck of a bottle or other vessel is inserted into the container through the opening in the wall thereof, an end portion of the said neck can be forced through the aperture of the retaining structure due to the resilient nature thereof, a lip of the said structure around the aperture therein engaging with the abutment surface to oppose movement of the neck of the bottle or other vessel out of the container and the neck of the bottle serving to close the container so as to prevent removal of the contents of the container through the said opening.

Since the neck of the bottle closes the container, the gift, or other content, cannot easily be removed. Furthermore, the retaining means prevents removal of the container from the neck of the bottle. To remove the gift from the container or the container from the bottle, the container must essentially be destroyed, making theft of the gift difficult.

In a preferred embodiment the wall of the container and the retaining means are of vacuum formed sheet material, for example, polyvinyl chloride (PVC), and the wall sections which make up the wall of the container are secured together by welding. Such a construction is very robust and needs considerable force to remove the resulting container from the bottle or to break open the container to remove its contents.

Embodiments of the invention will now be described in detail, by way of example, with reference to the drawings, in which.

Figure 1:
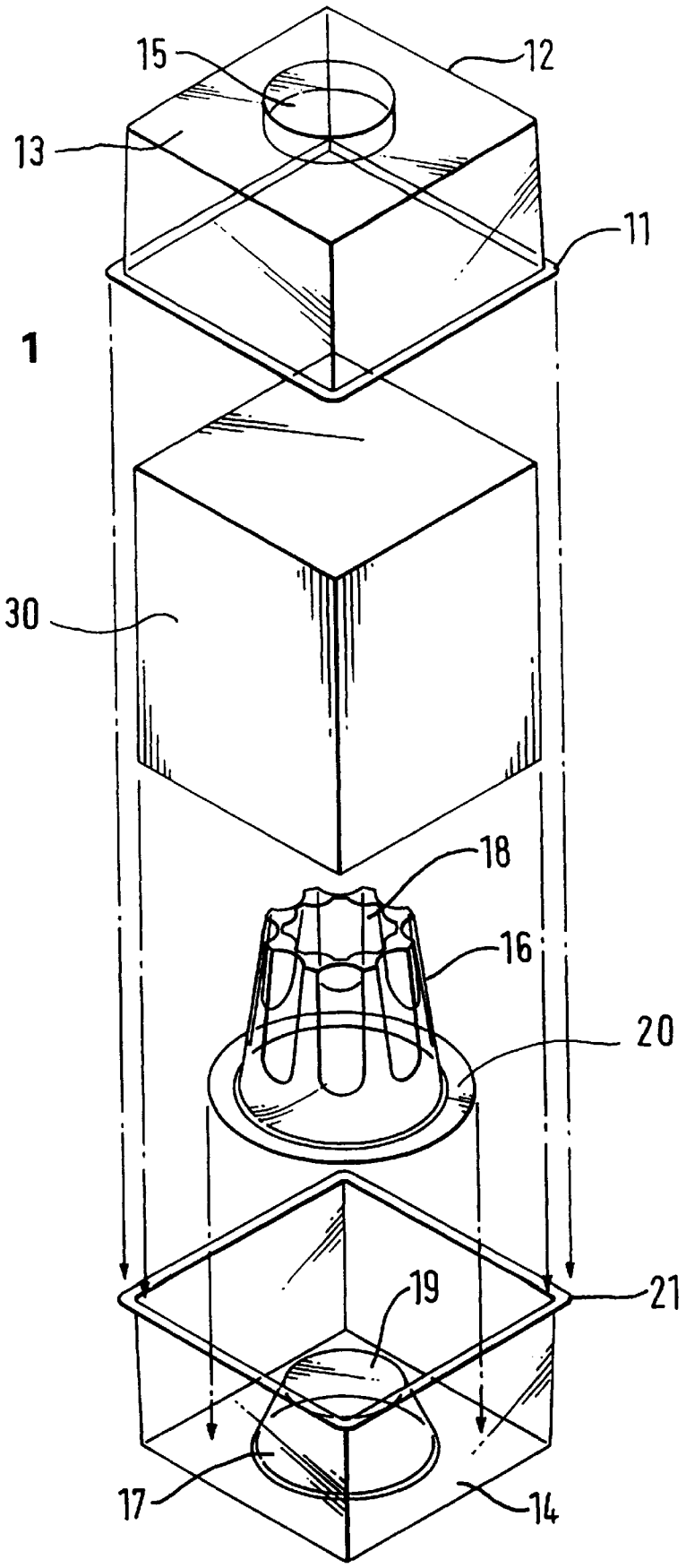
FIG. 1 is an exploded view of a first container in accordance with the invention.

The container 10 shown in FIGS. 1 to 3 of the drawings is of three part construction, comprising two box-like wall sections 12 and 14 of plastics material and a generally conical insert 16, which acts a retaining means to retain the container on the neck of a bottle or the like as will be described below.

The upper most box-like section 12 is an inverted, hollow body with an outwardly projecting flange 11 formed around the periphery of its free edge. As shown in the drawings, the box-like section 12 is generally rectangular or square but this shape is chosen purely for ease of accommodating a plurality of such containers contiguous to one another and other shapes may be chosen according to taste.

In the centre of the face 13 of the box-like section 12 remote from the flange 11 is a generally cylindrical protrusion which contains a similarly shaped recess 15, accessible from within the box-like wall section 12.

The other box-like wall section 14 is of a similar overall shape to the first, save that, in place of the cylindrical protrusion containing the recess 15 there is an opening 17 around which is positioned a generally frusto-conical skirt 19 which projects into the interior of the box-like section 14. The box-like section 14 is provided with an outwardly projecting flange 21 which is similar to that provided on the section 12.

Both box-like sections are preferably formed of thin semi-rigid plastics material, for example, of vacuum-formed PVC (polyvinyl chloride).

The insert 16 is generally frusto-conical with a semi-vertical angle similar to that of the skirt 19 formed around the opening in the second box-like section 14. It has an outwardly extending flange 20 at its wider end and the narrower portion of the insert 16 is divided to define a plurality of finger-like ridges separated by moulded grooves to give an overall corrugated effect. These corrugations serve to strengthen the insert 16 to reduce the likelihood of the insert being damaged or deformed to permit removal of the container from the bottle on which it is to be mounted. Ideally the insert 16 is made by vacuum forming a suitable material, for example, PVC. At its innermost end, the insert 16 has an opening or aperture 18 which is chosen to be of slightly smaller dimension than the annular abutment surface on the neck of a bottle on which the container is intended to fit.

The container 10 is assembled as follows.

The insert 16 is positioned in the second box-like section 14, over the frusto-conical skirt 19 which helps to support it. The flange 20 on the insert 16 is secured to the box-like section 14 by, for example, frequency welding. The gift (not shown) which is to be held in the container 10 is positioned within the box-like section 14 in the space between the insert 16 and the outer wall of the box-like section and the container 10 is then closed by positioning the other box-like section 12 so that its outwardly projecting flange 11 abuts the flange 21 on the section 14. The flanges 11 and 21 are secured to one another by frequency welding or any other suitable technique to close the container 10.

If desired, a printed insert 30, of cardboard or the like, bearing advertising or promotional information may be added before the two box-like sections are brought together to close the container 10.

It will be appreciated that at this stage the container 10, with its enclosed gift item forms a sealed unit which is largely tamper-proof, the gift item cannot be removed from the container without breaking the welded joints of the container 10 or, alternatively, cutting through the plastics material of which the container 10 is formed.

Figure 3:
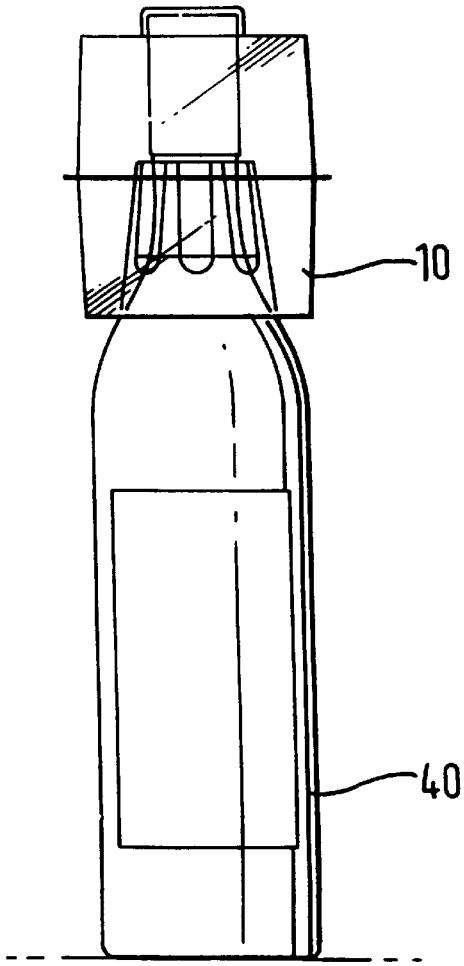
FIG. 3 shows the container of FIG. 1 in position on the neck of a bottle.

The container 10 can then be mounted on the neck of a bottle or like container with a relatively narrow neck, as shown in FIG. 3, simply by inserting the neck of the bottle 40 into the container through tie opening 17 formed in the box-like section 14. The bottle neck 40 passes through the opening 17 and the skirt 19, and is it continues to move into the interior of the container 10 it deforms the insert 16, which surrounds the opening 17, pushing through the narrower opening 18 at the innermost end of the conical insert 16. The insert 16 may simply be sufficiently elastic to allow it to stretch over the annular abutment surface on the bottle-neck or, alternatively, if the insert 16 is of less elastic material, then the corrugations may flatten out to increase the diameter of the innermost opening 18 temporarily to allow passage of the annular abutment.

The closed end of the bottle neck 40 is finally located in the recess 15 formed within the cylindrical protrusion on the box-like section 12, so that the container 10 is held relatively securely on the neck of the bottle and is not able to tilt relative to the bottle neck.

The insert 16 is chosen to be of such a length that, in this position, with the end of the neck of the bottle 40 within the recess 15, the free edge of the insert around the opening 18 abuts the annular underside of the moulded ring 42 usually found around the open end of a bottle neck to which the bottle cap is secured. The edge of the insert 16 is brought into this position by the natural resilience of the material of which it is made which causes the insert 16 to return to its original unstressed condition and, hence to be urged inwards.

Any attempt to remove the container 10 from the neck of the bottle 40 forces the edge of the insert around the opening 18 against the underside of the moulded ring 42, opposing movement of the container 10 off the neck of the bottle 40. In practice, it is very difficult, if not virtually impossible, because of the strength of the plastics material used, to remove the container and its contents.

Figure 2:
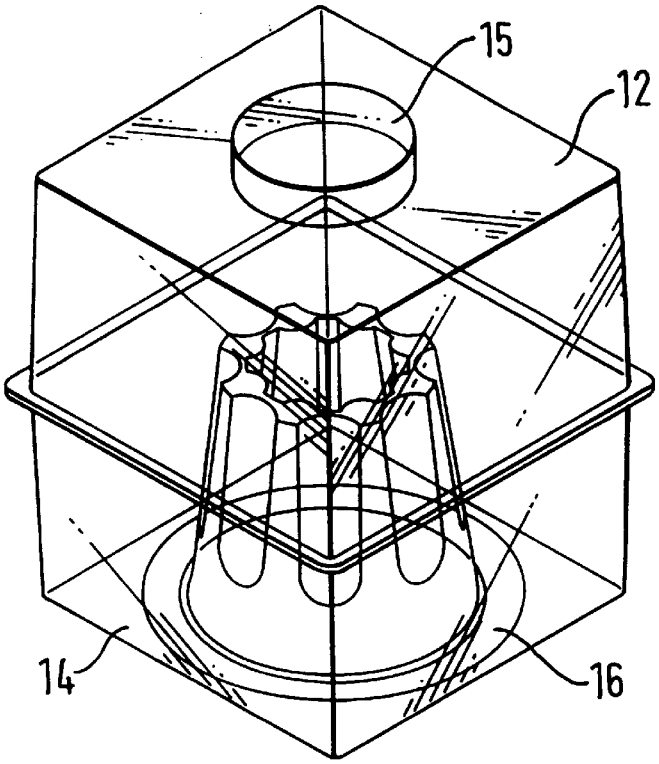
FIG. 2 is a view of the container of FIG. 1, fully assembled.
Figure 6:
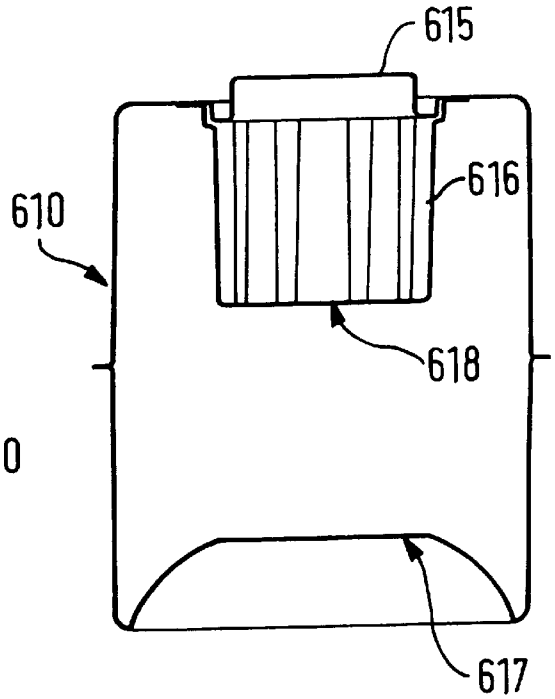
FIG. 6 is a sectional view of a fourth container in accordance with the invention.
Figure 5:
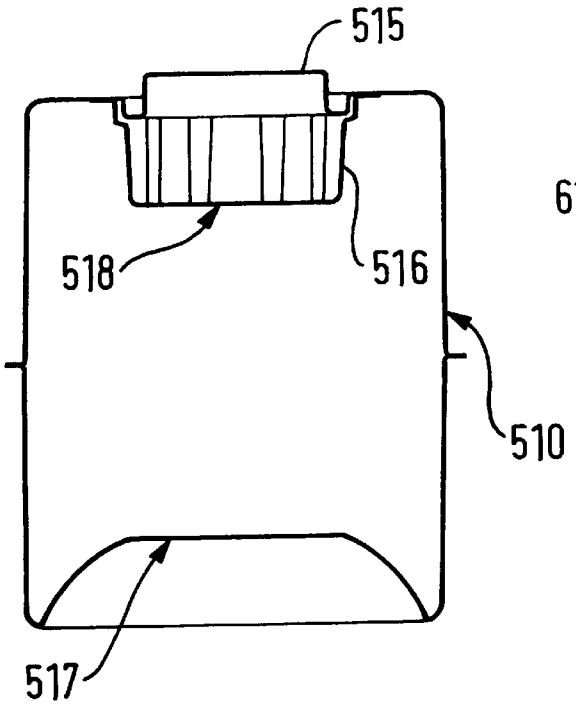
FIG. 5 is a sectional view of a third container in accordance with the invention.
Figure 4:
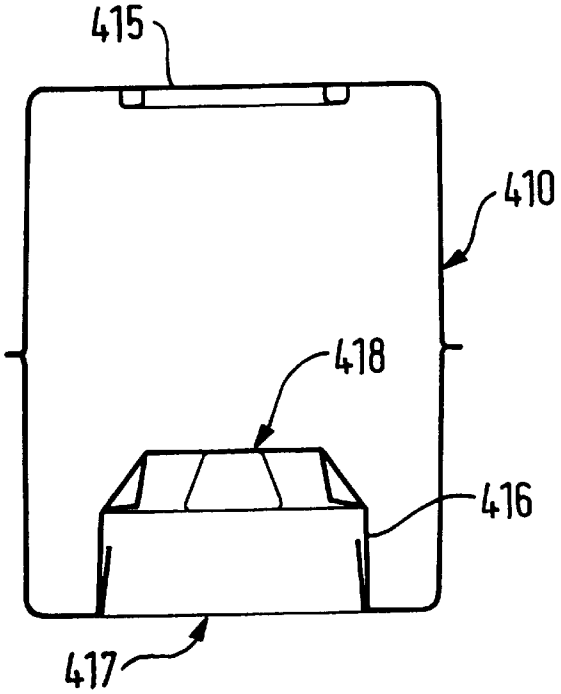
FIG. 4 is a sectional view of a second container in accordance with the invention.

The container shown in FIGS. 1 to 3 of the drawings has the retaining structure formed by the insert 16 mounted on the periphery of the container wall around the opening 17 into the container 10. However, tie precise construction of the container, the positioning of the retaining structure and its dimensions may be chosen to accommodate bottles of any number of different configurations. The containers illustrated in FIGS. 4 to 6 show examples of containers 410, 510 and 610 adapted to accommodate bottles having necks of different shapes. (The views shown in FIGS. 4 to 6 are analogous to one another and, for ease of understanding like parts have been given like reference numerals, differentiated by the first digit which refers to the number of the figure.)

The container shown in FIG. 4 is similar to that of FIGS. 1 to 3 in that the retaining structure 416 is positioned on the wall of the container 410 immediately surrounding the opening 417. However, the insert 416 which forms the retaining structure is different in shape to that of FIGS. 1 to 3, being generally cylindrical apart from a short conical section immediately adjacent the innermost opening 418. The insert 416 is also considerably shorter in an axial direction than that if FIGS. 1 to 3 since the container of FIG. 4 is intended to accommodate a bottle having the annular abutment surface on its neck, which is, in use, engaged by the edge of the insert 416 around the opening 418, spaced from the top of the bottle neck by a greater distance than would be the case in FIGS. 1 to 3.

In FIGS. 5 and 6 the containers 510 and 610 differ from those described above in that the retaining structure formed by the inserts 516 and 616 is secured to the wall of the container 510 and 610 at a position remote from and opposite to the opening 517 and 617 through which the neck of the bottle is to be inserted into the container. As shown in FIGS. 5 and 6, the retaining structures surround the cylindrical recesses 515 and 615 formed in the walls of the containers 510 and 610 which, in use, receive the top-most part of the bottle cap or cork and serve to steady the container against tipping or tilting.

Although the retaining structures formed by the inserts 516 and 616 are differently positioned, they function in much the same way as the inserts 16 and 416 of FIGS. 1 to 4, with the free , innermost end of the insert around the inner opening 518 and 618 lodging beneath the annular abutment on the neck of the bottle.

It will be noted that the area of the container wall around the opening 517 and 617 in the containers of FIGS. 5 and 6 is curved to accommodate a bottle having a curved shoulder and to allow the container to sit firmly on the shoulder of such a bottle.

The containers 510 and 610 of FIGS. 5 and 6 differ from one another in that they are agin intended to be used with bottles having differing separations between the top-most part of the bottle cap and cork and the annular abutment surface on the bottle neck. The container 610 of FIG. 6 is intended to fit a bottle in which this separation is greater than that of the bottle which container 510 of FIG. 5 will fit.

Figure 7:
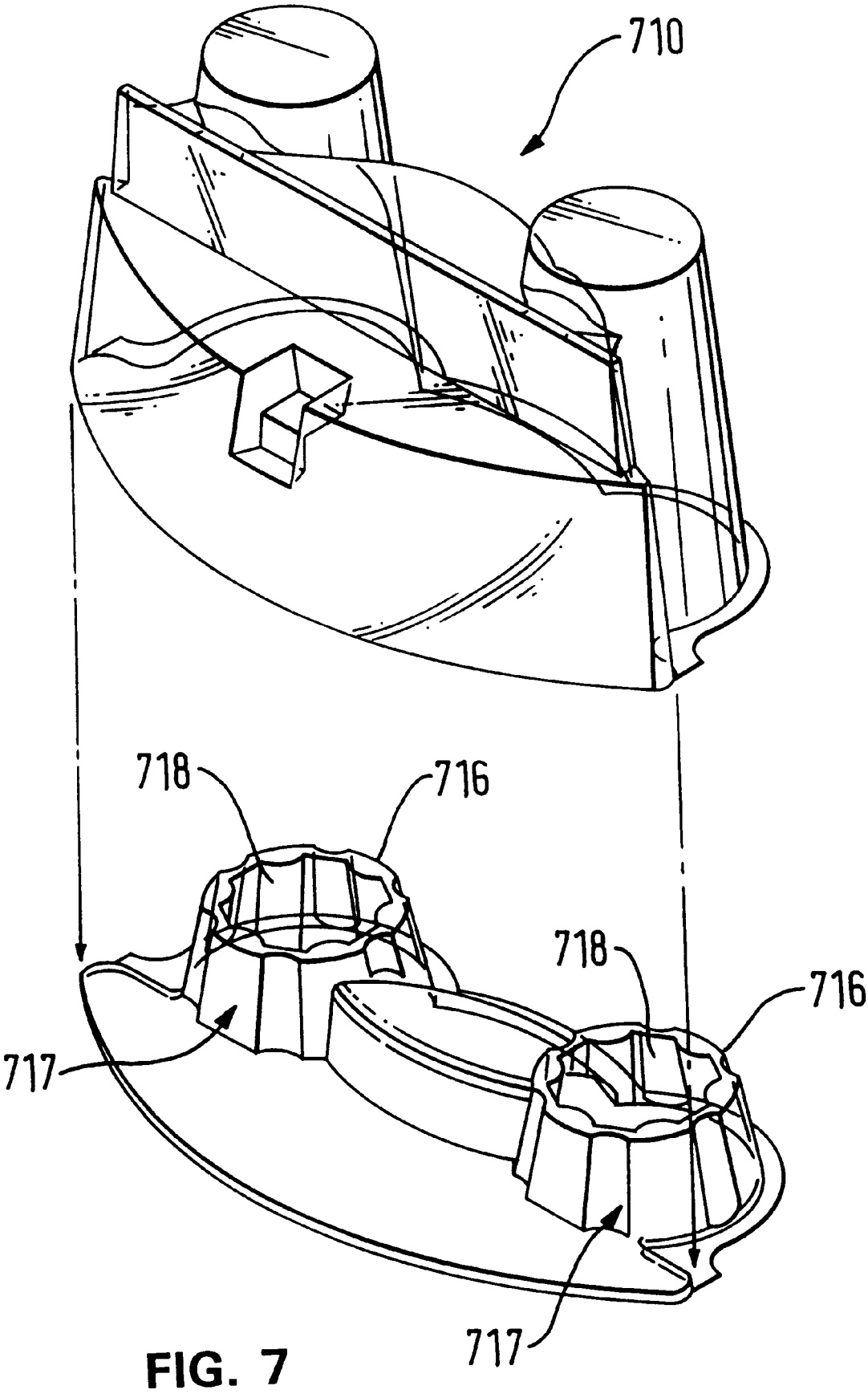
FIG. 7 is an exploded perspective view of a fifth container in accordance with the invention.
Figure 8:
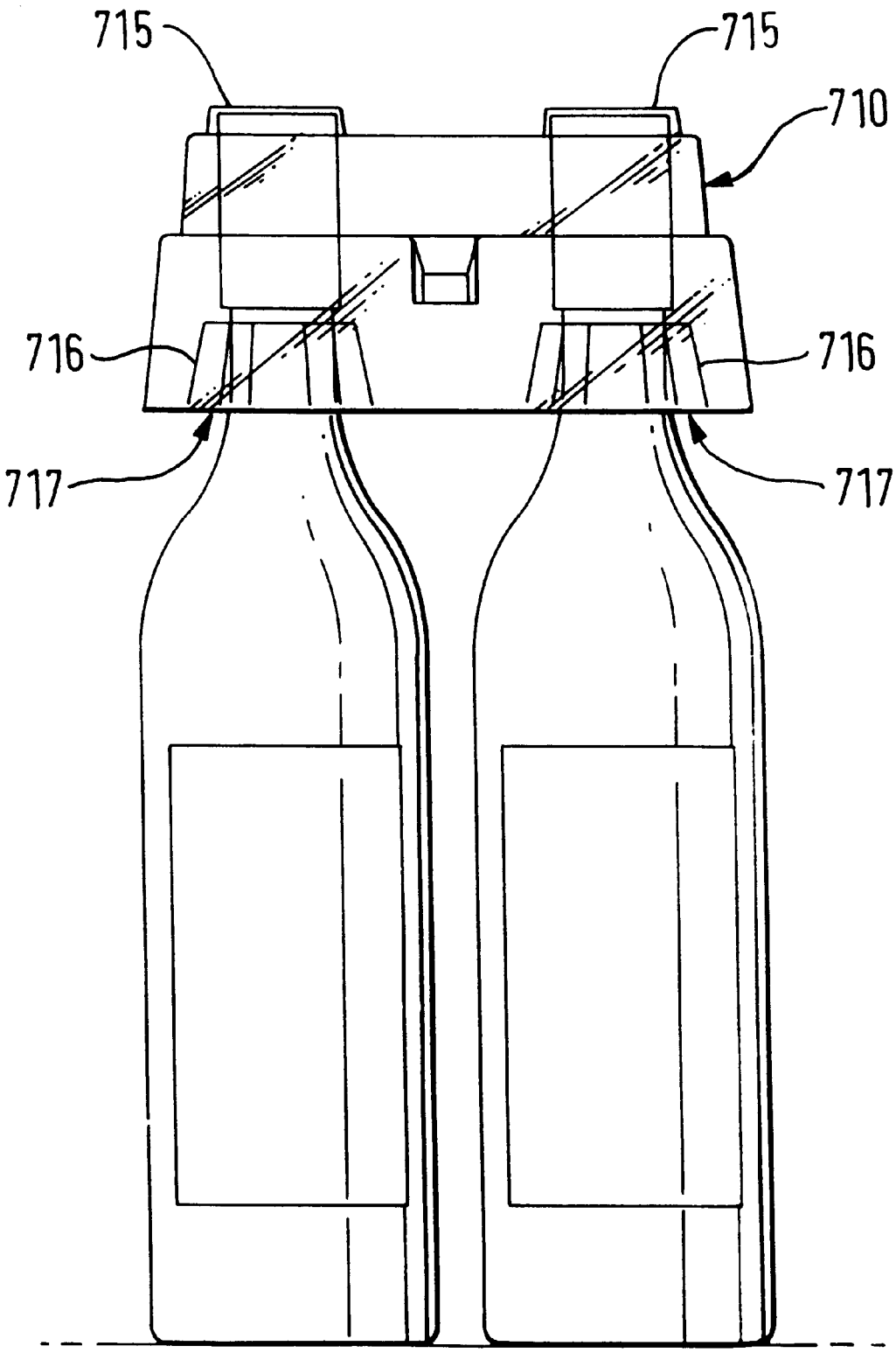
FIG. 8 shows the container of FIG. 7 mounted on the necks of a pair of bottles.

FIGS. 7 and 8 show a container 710 which is of quite different shape to the generally rectangular box-like shapes of the containers shown in FIGS. 1 to 6 and which, furthermore is intended to be fitted to the necks of a pair of bottles sold together as a single promotional unit. The container 710 of FIG. 7 thus has the additional advantage that it may be used to secure bottles together in a permanent and easy-to-achieve manner.

Although the container 710 has two inserts 715 which are the same, it will be appreciated that by using different inserts, the container may be adapted to secure together bottles of different kinds.

It will be understood that the invention provides a secure means for attaching a gift item to a bottle as part of a promotional exercise. The container of the invention, is cheap and easy to manufacture using conventional techniques. Further more, fitting of the containers on to the necks of bottles is an operation which requires no particular skill and can be carried out at any point in the movement of bottles from the initial packaging of the bottles to placing the bottles on a shelf for retail display.

Whilst the invention has been described by reference to bottles with relatively narrow necks, it will be appreciated that the container of the invention may be modified to fit any vessel or container having a suitable abutment surface for engagement by the retaining structure or structures.

What is claimed is:

1. A container for mounting on the neck of a bottle or other vessel having an annular abutment surface formed thereon, the container comprising:

a wall which defines a generally closed space, said wall being formed of two or more wall sections secured together to form a sealed unit;

an opening formed in said wall for receiving the neck of the bottle or other vessel; and a resilient retaining structure housed in said closed space and being connected to said wall, said retaining structure having an aperture which is aligned with said opening formed in the container wall and has dimensions slightly smaller than those of the annular abutment surface on the neck of the bottle, said retaining structure being such that when the neck of a bottle or other vessel is inserted into the container through said opening in said wall thereof, an end portion of said neck can be forced through said aperture of said retaining structure due to the resilient nature thereof, a lip of said retaining structure around said aperture therein engaging with the abutment surface to oppose movement of the neck of the bottle out of the container and the neck of the bottle serving to close the opening in the container so as to prevent removal of the contents of the container through said opening.

2. The container according to claim 1, wherein said retaining structure is of a material sufficiently elastic to permit it to stretch temporarily to increase the size of said aperture therein and, hence, to allow the annular abutment on the neck of the bottle to pass therethrough.

3. The container according to claim 1, wherein said retaining structure is formed of a continuous sleeve of material, said sleeve having formed therein at least one longitudinally extending corrugation, the material of the sleeve being sufficiently resilient to allow, in use, the corrugation to deform temporarily to increase the size of said aperture therein, and hence, to allow the annular abutment on the neck of the bottle to pass therethrough.

4. The container according to claim 1 in which said retaining structure is generally frusto-conical tapering towards the aperture therein so that said retaining structure, in use, guides the neck of the bottle into alignment with the aperture thereof.

5. The container according to claim 1 in which said wall is formed of at least two wall sections fixed together by welding.

6. The container according to claim 1 in which the retaining structure is of vacuum-formed sheet material.

7. The container according to claim 1, wherein said wall has two or more said openings and two or more said retaining structures, each of which is aligned with and spaced from a respective one of the openings, so that the container can be mounted on the necks of two or more bottles and secures them together.

8. The container according to claim 1, wherein first and second said wall sections respectively include first and second closed walls and top and bottom walls fixed to first ends of the respective said first and second closed walls, second ends of said first and second closed walls being fixed together to define said closed space interiorly thereof, said first and second closed walls and said top wall being free of openings, and only one said opening being formed in and having a width less than the width of said bottom wall so that said opening is the only access into said closed space, whereby access into said closed space is blocked by insertion of a neck of a bottle into said opening.

9. The container according to claim 8, wherein said retaining structure includes a cylindrical part connected to said bottom wall and projecting into said closed space, and a frusto-conical part connected to an end of said cylindrical part remote from said bottom wall and including said aperture therein, said frusto-conical part being adapted to engage the bottle to hold said container on the bottle.

10. The container according to claim 8, wherein said retaining structure is fixed to said top wall remote from said bottom wall and extending into said closed space toward said opening, whereby a bottle inserted through said opening extends through said closed space and then contacts said retaining structure.

11. The container according to claim 10, wherein said top wall includes a recess which receives a first inserted end of the bottle, whereby said retaining structure and said recess support said container on a bottle.

12. The container according to claim 8, wherein said top wall includes a recess which receives a first inserted end of the bottle and is spaced from said retaining structure, whereby said container is supported on a bottle at both said retaining structure and said recess.

13. The container according to claim 12, wherein said recess is a cylindrical protrusion on said top wall extending away from said closed space, and said cylindrical protrusion being aligned with said opening and said aperture.

14. The container according to claim 8, wherein said retaining structure is a frusto-conical insert, a base of said frusto-conical insert being connected to said bottom wall, an apex of said frusto-conical insert be:-ng spaced from said bottom wall into said closed space, and said aperture being formed in said apex and opening into said closed space.

15. The container according to claim 14, wherein said second ends of said first and second closed walls respectively include first and second flanges, and after insertion of contents and said frusto-conical insert into said closed space, said first and second flanges being welded together, whereby said frusto-conical insert is inaccessible without destroying the container and removal of the container from the bottle, of contents of the container, and of contents of the bottle is prevented.

16. The container according to claim 14, wherein said bottom wall includes a frusto-conical skirt extending into said space, said skirt surrounding said opening in said bottom wall and guiding the bottle into said frusto-conical insert.

17. The contain er according to claim 16, wherein said skirt and said insert extend at a similar semi-vertical angle relative to the axis of said insert.

18. A container for mounting on a neck of a bottle or other vessel, said neck having an annular abutment surface formed thereon, the container comprising:

a wall which defines a generally closed internal volume, said wall of the container being formed of two or more wall sections fixed together to form a sealed unit;

an opening formed in said wall for receiving the neck of said bottle or other vessel; and a resilient retaining structure having an aperture which is aligned with said opening formed in said container wall and has dimensions slightly smaller than those of said annular abutment surface on said neck of the bottle, said structure being such that when said neck is inserted into the container through said opening in said wall thereof, an end portion of said neck can be forced through said aperture due to the resilient nature of said retaining structure, a lip of said retaining structure around said aperture engaging the abutment surface to oppose movement of said neck out of said internal volume and said neck closing the container so as to prevent removal of the contents of the container through said opening, said retaining structure being entirely disposed within said internal volume defined by the wall of said container so as to engage said abutment surface on said bottle neck in the internal volume of said container.

19. A container for mounting to a neck of a vessel, the neck having an abutment surface thereon, the container comprising:

a closed wall defining a closed interior space, said wall including a substantially planar wall section, which has one vessel neck-receiving opening therein, said wall being free from openings therein except for said vessel neck-receiving opening, said opening having a width less than the width of said wall section, and a resilient retaining structure fixed in said space and having a lip defining an aperture aligned with and spaced from said opening, said aperture being dimensioned to be slightly smaller than the abutment surface of the neck so that when the neck is forced into said closed space the abutment surface contacts said lip which resiliently yields to allow the abutment surface therepast into said space, said lip contacting beneath the abutment surface to hold the container on the neck of the vessel, the vessel blocking access to said space and said container blocking access to a mouth of said vessel both by the vessel closing said vessel neck-receiving opening.

* * * * *